US010247182B2

(12) United States Patent
Zhang et al.

(10) Patent No.: US 10,247,182 B2
(45) Date of Patent: Apr. 2, 2019

(54) WELL STIMULATION PUMP CONTROL AND METHOD

(71) Applicant: Caterpillar Inc., Peoria, IL (US)

(72) Inventors: Yanchai Zhang, Dunlap, IL (US); Zhaoxu Dong, Dunlap, IL (US); Xuefei Hu, Mossville, IL (US)

(73) Assignee: Caterpillar Inc., Deerfield, IL (US)

( * ) Notice: Subject to any disclaimer, the term of this patent is extended or adjusted under 35 U.S.C. 154(b) by 521 days.

(21) Appl. No.: 15/015,339

(22) Filed: Feb. 4, 2016

(65) Prior Publication Data

US 2017/0226998 A1 Aug. 10, 2017

(51) Int. Cl.

| | |
|---|---|
| ***F04B 17/03*** | (2006.01) |
| ***F04B 47/00*** | (2006.01) |
| ***F04B 49/06*** | (2006.01) |
| ***F04B 49/20*** | (2006.01) |
| ***F04B 49/22*** | (2006.01) |
| ***F04B 51/00*** | (2006.01) |

(52) U.S. Cl.

CPC ..... *F04B 49/065* (2013.01); *F04B 17/03* (2013.01); *F04B 47/00* (2013.01); *F04B 49/20* (2013.01); *F04B 49/22* (2013.01); *F04B 51/00* (2013.01); *F04B 2205/02* (2013.01)

(58) Field of Classification Search

CPC ..... F04B 49/065; F04B 49/22; F04B 49/20; F04B 47/00; F04B 17/03; F04B 51/00; F02B 63/04; F04D 15/0027; F04D 15/0066; F04D 15/0077; F04D 27/004; F04C 14/08; F04C 28/08; E21B 43/26

See application file for complete search history.

(56) References Cited

U.S. PATENT DOCUMENTS

| | | | | |
|---|---|---|---|---|
| 6,655,922 | B1 | 12/2003 | Flek | |
| 6,663,349 | B1 * | 12/2003 | Discenzo | F04D 15/0245 417/300 |
| 6,709,241 | B2 | 3/2004 | Sabini et al. | |
| 6,859,740 | B2 | 2/2005 | Stephenson et al. | |
| 7,162,924 | B2 | 1/2007 | Ramamoorthy et al. | |
| 7,726,179 | B2 * | 6/2010 | Muller | F04B 43/0072 73/37 |
| 7,797,142 | B2 | 9/2010 | Salomon et al. | |
| 7,912,687 | B2 | 3/2011 | Stockner et al. | |
| 8,543,245 | B2 * | 9/2013 | Heitman | F04B 49/065 137/836 |
| 8,696,321 | B2 | 4/2014 | Zeqiri | |
| 2007/0022802 | A1 * | 2/2007 | Rogers | E21B 21/01 73/53.01 |
| 2009/0314688 | A1 * | 12/2009 | Gordon | B01F 5/0644 208/223 |
| 2010/0300683 | A1 * | 12/2010 | Looper | E21B 21/06 166/250.01 |
| 2014/0010671 | A1 * | 1/2014 | Cryer | B60W 10/30 417/53 |

* cited by examiner

*Primary Examiner* — Devon C Kramer
*Assistant Examiner* — Christopher J Brunjes

(57) ABSTRACT

A pumping system for use in a well stimulation application includes a pump controlled by a controller, the controller operating to monitor operation of the pump and determine when cavitation is present or imminent in the pump. When cavitation is present, the controller automatically adjusts an operating condition of the pump reduce pump speed or increase a fluid pressure at the pump inlet.

19 Claims, 6 Drawing Sheets

WELL STIMULATION PUMP CONTROL AND METHOD

TECHNICAL FIELD

This patent disclosure relates generally to pumps having reciprocating pistons and, more particularly, to a system and method for controlling a pump for use in well stimulation applications.

BACKGROUND

Hydraulic fracturing, which is also sometimes referred to as fracing or fracking, is a process used to initiate and/or stimulate oil or gas extraction from reservoirs having low permeability. During a hydraulic fracturing process, outflow or production of gas or oil from a new a new or existing well is stimulated by injecting a fluid into the well at a high pressure. The high pressure fluid, which may include a granular material as a slurry and/or agents increasing the viscosity of the fluid, acts on the walls of the well to produce fractures or cracks, which permit hydrocarbons and other fluids to flow more freely into or out of the well bore.

In a typical installation, water or another fluid is mixed on-site with granular materials such as sand and other agents to produce the fracturing fluid using a mixture. The fracturing fluid is then provided to a pump, which pressurizes the fluid and provides it down the well. Given the relatively high operating pressures that are required to fracture the well walls, the fracturing fluid may undergo cavitations during the pumping process and, especially, within the pump. Such cavitation can prematurely wear internal pump components and decrease pump efficiency.

SUMMARY

The disclosure describes, in one aspect, a pumping system for use in a well stimulation application. The pumping system includes a pump having an inlet and at least one pumping element, each pumping element including a piston reciprocally disposed in a bore, an inlet check valve in fluid communication with the inlet and an outlet check valve associated with a variable volume defined in a bore. A pressure sensor is disposed to measure a fluid pressure at a location between the inlet check valve and the inlet of the pump. A drive mechanism drives a reciprocal motion of the piston. A speed sensor is disposed to measure a speed of the pump at the drive mechanism, and a controller is associated with the pump and disposed to receive signals indicative of the fluid pressure and the speed of the pump. The controller is programmed to determine an operating point of the pump based on the fluid pressure and the speed of the pump, compare the operating point of the pump with a cavitation map that is predefined, determine whether cavitation is present in the at least one pumping element based on a result of the comparison between the operating point and the cavitation map and, when cavitation is present, at times, adjust an operation of the drive mechanism to reduce a speed of the pump and/or, in certain embodiments, increase the inlet pressure to the pump.

In another aspect, the disclosure describes a method for operating a pump for use in a hydraulic fracturing system. The method includes using a controller to select one appropriate cavitation map from a plurality of cavitation maps stored in the controller, where the selection is made based on operating parameters of the hydraulic fracturing system. The controller is used to monitor operation of the hydraulic fracturing system with regard to at least a pressure of stimulation fluid at an inlet of a pump, and a speed of the pump, to determine an operating condition of the pump, compare the operating condition of the pump with the selected one appropriate cavitation map, and determine whether cavitation is present or imminent in the pump based on a result of the comparison. When cavitation is present, the controller is used to adjust the operating condition of the pump, in real time.

DETAILED DESCRIPTION

This disclosure relates to well stimulation pumps for use in well stimulation operations involving hydraulic fracturing and, more particularly, to a control system that automatically monitors pump operating parameters and compares the operating parameters to predefined maps to determine whether fluid cavitation may be occurring within the pump, or is about to occur. When fluid cavitation is determined to be present or imminent, the control system automatically intervenes to avoid or reduce cavitation. In the described embodiments, controller intervention may cause the speed of the pump to reduce, and/or a pressure of well stimulation fluid to increase, such that cavitation of fluid within the pump is reduced, eliminated or avoided, to increase pumping efficiency and to reduce wear or possible damage to pump components.

In general, during well stimulation operations, cavitation in the well stimulation fluid can occur due to the relatively high flow rate of fluid ingested by the various pumping elements of the well stimulation pump. In certain conditions, fluid cannot move fast enough into the suction side of each respective pumping element due to high pump speed and low fluid inlet pressure. To prevent the cavitation and increase the efficient of pump, a closed loop cavitation prevention strategy can be used. In the embodiments described herein, the prevention strategy operates on a model-basis, and monitors pump operating conditions to determine whether conditions favorable for cavitation are present. The described embodiments, therefore, include a model-based closed loop strategy. The strategy includes a cavitation map, which is based on analytical information, for example, computational fluid dynamics (CFD) modeling at different pump speed and different inlet pressures.

A series of cavitation maps may be generated to cover many different fluid types and slurries, as well as the particular geometry of the pumping elements and fluid conduits within the pump. In one embodiment, a cavitation check status indicator of zero (0) or one (1) is used. During operation, a cavitation status indicator of "0" indicates that the current pump speed and current inlet pressure conditions are safe and not conducive to cavitation. When operating conditions change, which create a likelihood of cavitation, the cavitation status indicator changes from "0" to "1," which indicates that cavitation is possible. To avoid cavitation from occurring, or to eliminate cavitation that may already be occurring, the control strategy automatically changes the pump operating conditions, for example, by reducing pump speed and/or increasing fluid pressure at the pump inlet. Additionally, the system may alert an operator of the condition.

Figure 1:
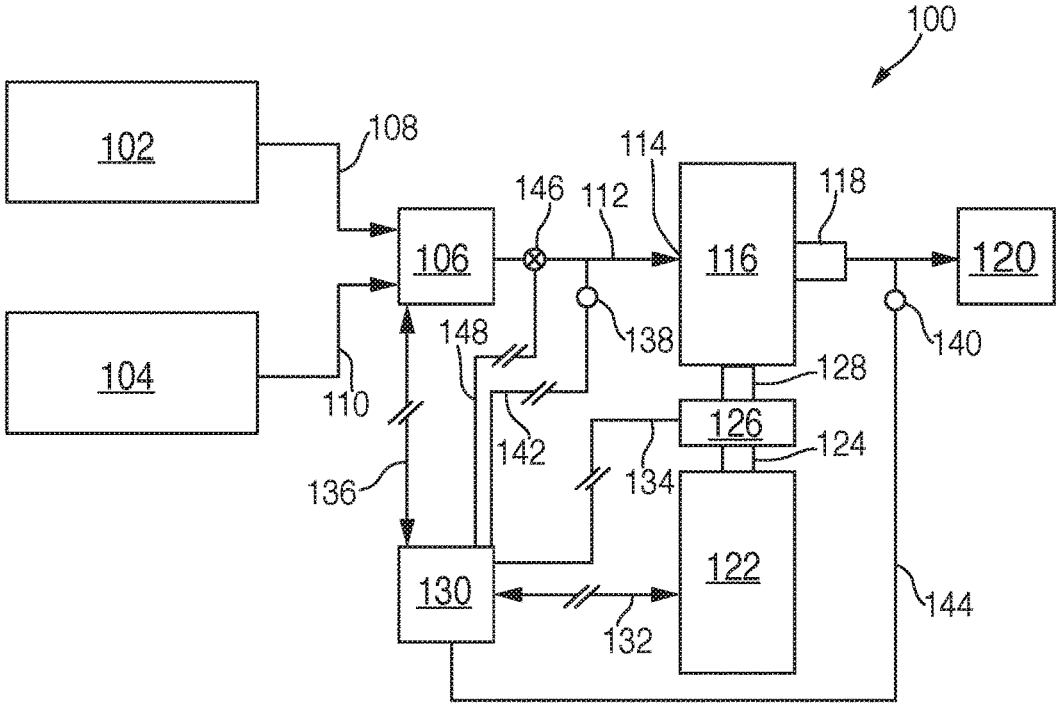
FIG. 1 is a block diagram of a wall stimulation system in accordance with the disclosure.

A block diagram of a well stimulation system 100 is shown in FIG. 1. In the illustrated embodiment, the well stimulation system 100 includes a liquid reservoir 102, which includes water, and an additive reservoir 104 for supplying a granular additive such as sand, but other fluids and additives can be used for a well stimulation operation as is known. Other compounds affecting the properties of the liquid such as gelling agents and other substances can also be used. Moreover the granular additive may be omitted for certain applications. The system 100 further includes a mixer 106, which receives or draws a desired liquid flow 108 from the liquid reservoir 102 and a desired material flow 110 from the additive reservoir 104, and mixes these two flows, along with, optionally, other compounds and agents, to provide a flow of slurry or well stimulation fluid 112 to an inlet 114 of a pump 116.

During operation, operation of the systems associated with the mixer 106 are arranged to provide the stimulation fluid 112 at a desired composition, viscosity, flow rate and/or pressure to the pump 116. The pump 116 operates to compress the stimulation fluid 112 and provide the same at an outlet 118, from where the pressurized stimulation fluid 112 is provided to a well head 120. The pump 116 is powered by a power unit 122. The power unit 122 has an output shaft 124 connected to a transmission 126, which is in turn connected to a pump input shaft 128. Powered rotation of the output shaft 124 is thus transmitted to the input shaft 128 of the pump 116 via the transmission 126, which can adjustably control the speed, direction and torque with which the pump 116 is operated. Any suitable source of power can be used to operate the pump 116. In the illustrated embodiment, the power unit 122 includes an internal combustion engine connected to a generator that produces electrical power. The electrical power is provided to an electric motor, which in turn powers the output shaft 124. Additional details of the power unit 122 are not provided herein for simplicity.

The well stimulation system 100 further includes an electronic controller 130, which is operably connected or associated, directly or indirectly, with various components and systems. The electronic controller may be a single controller or may include more than one controller disposed to control various functions and/or features of the system 100. For example, a master controller, used to control the overall operation and function of the system, may be cooperatively implemented with a motor or engine controller, used to control the various components of the power unit 122. In the present disclosure, the term "controller" is meant to include one, two, or more controllers that may be associated with the system 100 and that may cooperate in controlling various functions and operations of the system 100 (FIG. 1). The functionality of the controller, while shown conceptually in FIG. 7 hereinafter to include various discrete functions for illustrative purposes only, may be implemented in hardware and/or software without regard to the discrete functionality shown. Accordingly, various interfaces of the controller are described relative to components of the system. Such interfaces are not intended to limit the type and number of components that are connected, nor the number of controllers that are described.

In the diagram of FIG. 1, the controller 130 is connected with or otherwise associated with and configured to exchange information with various sensors and actuators controlling operation of the system 100. More specifically, in the illustrated embodiment, the controller 130 is associated with the power unit 122 via a communication line 132. The communication line 132 may assume any appropriate form of communication of analog and/or digital information and command signals between the power unit 122 and the controller 130 to effect the selective control and monitoring of various parameters controlling the operation of the power unit 122. The controller 130 is further associated with the transmission 126 via a communication line 134, and with the mixer 106 via a communication line 136. An input sensor 138 and an output sensor 140 respectively monitor the flow rate, temperature, composition, pressure and/or viscosity of the inlet and outlet streams of stimulation fluid provided to, and also provided from, the pump 116. The input sensor 138 and the output sensor 140 are associated with the controller 130 via a first line 142 and a second line 144 to provide signals indicative of the parameters measured to the controller 130 for adjusting the operation of the system 100 during operation. A valve 146, which may also include a pressure regulation function, is connected along a fluid conduit connecting the mixer 106 and the pump 116 that carries the well stimulation fluid 112. The valve 146 is responsive to commands provided from the controller 130 via a valve control line 148.

Figure 2:
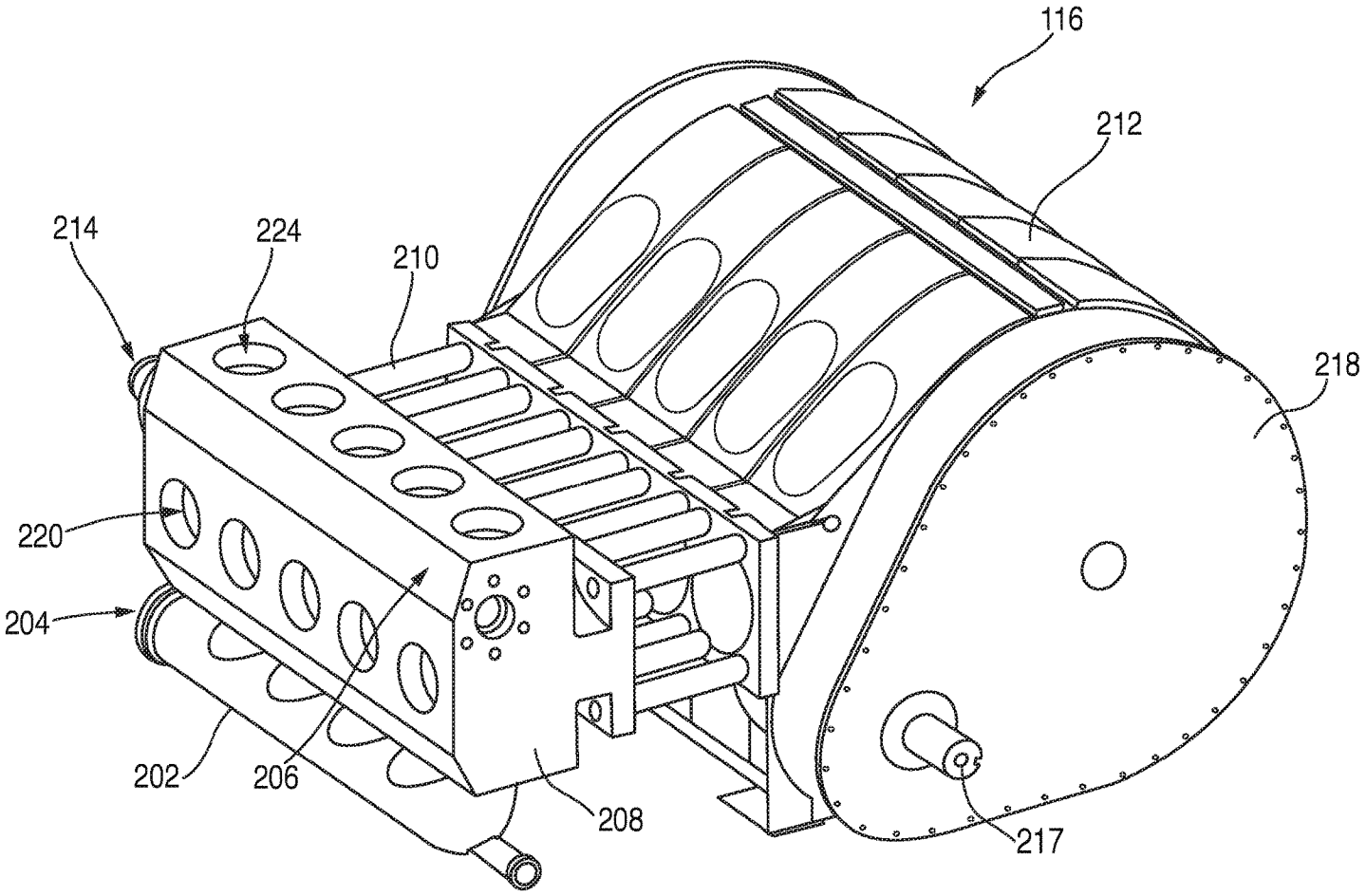
FIG. 2 is a perspective view of a well stimulation pump in accordance with the disclosure.
Figure 3:
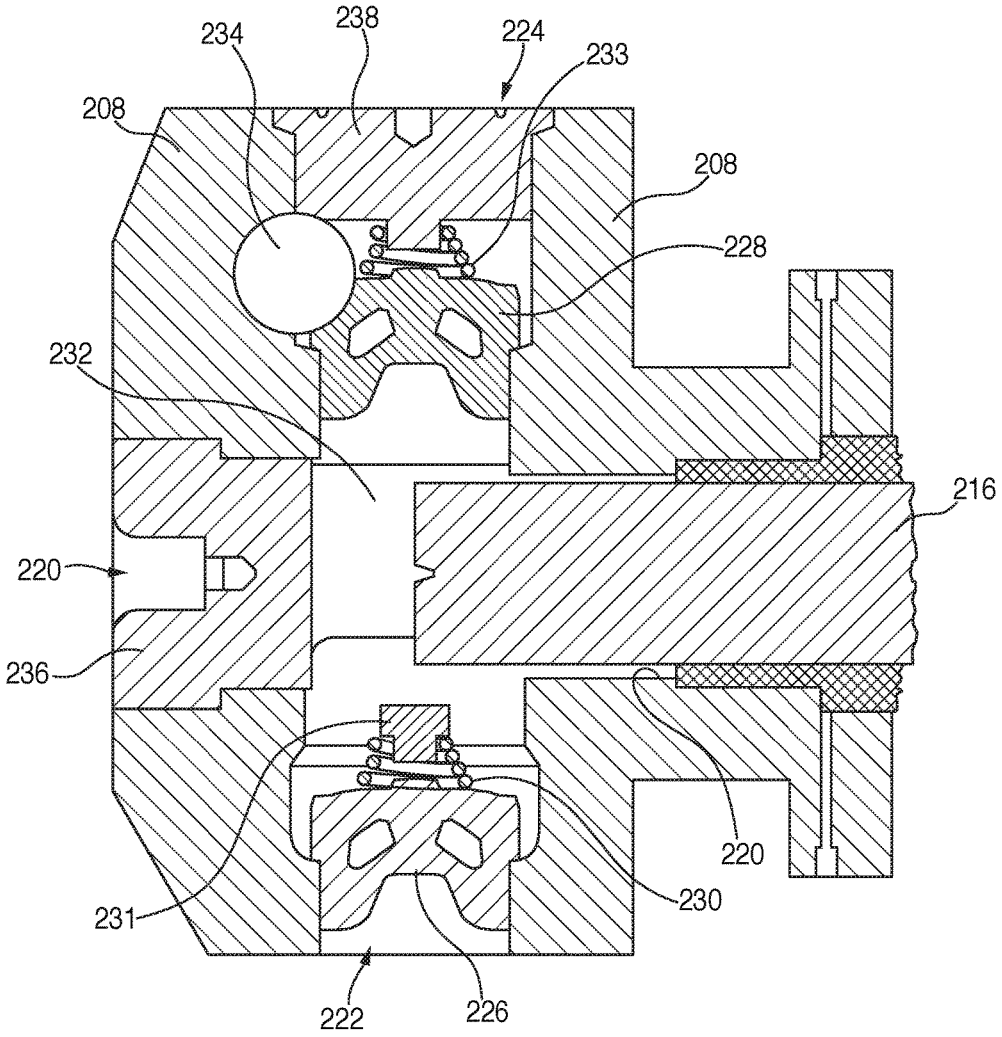
FIG. 3 is a partial cross section of a pumping element of the pump shown in FIG. 2.

One embodiment for the pump 116 is shown in FIG. 2 from a perspective view. The pump 116 shown in FIG. 2 is one possible embodiment and presents one typical pump configuration, but it should be appreciated that other pump configurations and types can be used. The pump 116 shown includes a suction manifold or inlet manifold 202 that distributes stimulation fluid provided to an inlet 204 to various pumping elements 206. In the illustrated embodiment, the pump 116 includes five pumping elements 206, but a single pumping element, fewer, or more than five pumping elements may be used. A cross section through one of the pumping elements 206 is shown in FIG. 3. The pumping elements 206 are formed in a header 208 that is connected via tension bars 210 to a drive housing 212. The drive housing 212 includes various components providing the motion required for each pumping element 206 to compress the stimulation fluid provided through the inlet manifold to a respective outlet and to an outlet opening 214. Various outlet openings and configurations may alternatively be used. As shown, the drive housing 212 includes a crackshaft connected via connecting rods to pistons 216 that pump the stimulation fluid. Power to drive the crackshaft (not shown) is provided at an inlet shaft 217. The various components of the drive mechanism are disposed within the drive housing 212 and are closed by a cover 218.

In reference now to FIG. 3, an end portion of a piston 216 disposed in a pumping element 206 is shown. The piston 216 reciprocates during operation within a bore 220. The bore 220 is fluidly connectable to an inlet bore 222, from which stimulation fluid supplied by the inlet manifold 202 is available, and to an outlet bore 224, through which compressed stimulation fluid is provided to the outlet opening 214. The fluid connectivity of the bore 220 during operation is controlled by an inlet check valve 226 and an outlet check valve 228.

More specifically, the inlet check valve 226 is biased by a spring 230 acting on the valve and a stop 231 towards a seated position. When the piston 216 retracts within the bore 220, a vacuum created causes the inlet check valve 226 to open and allow stimulation fluid to fill a variable volume chamber 232 defined between the bore 220 and the piston 216. When the variable volume chamber 232 has filled with stimulation fluid, and the retraction of the piston 216 has stopped, the direction of motion of the piston reverses such that the piston 216 begins extending into the bore 220 such that the volume of the variable volume chamber 232 decreases.

As the volume of the variable volume chamber 232 decreases, a pressure of stimulation fluid found therein increases, which closes or keeps the inlet check valve 226 in a closed or seated position. At the same time, the pressure of the stimulation fluid increases until a closing force of a spring 233 acting to keep the outlet check valve 228 in a seated position is overcome and the outlet check valve 228 opens to fluidly connect the variable volume chamber 232 with an outlet passage 234 that is formed in the header 208 and that is fluidly connected with the outlet opening 214. A service plug 236 covers an end of the bore 220, and an outlet plug 238 provides a stop for the spring 233 acting on the outlet check valve 228.

Under certain operating conditions, for example, when pressure or flow rate of stimulation fluid at the inlet opening is relatively low, and stimulation fluid cannot fill the variable volume chamber 232 quickly enough for higher pump speeds, cavitation may occur around the open seat of the inlet check valve 226, behind the piston 216, and in other areas. Such cavitation may reduce the overall pumping efficiency of the pump, and also cause increased wear on the mechanical components of the pump. The appearance of cavitation in the pumping elements can depend on various factors including ambient temperature and pressure, but can also depend on other factors that are specific to the stimulation fluid used with the pump such as composition, viscosity and the like, in addition to physical parameters of the system such as a head loss in fluid pressure due to piping, the pressure and maximum flow rate of the stimulation fluid that is available to the pump, and the like.

Figure 4:
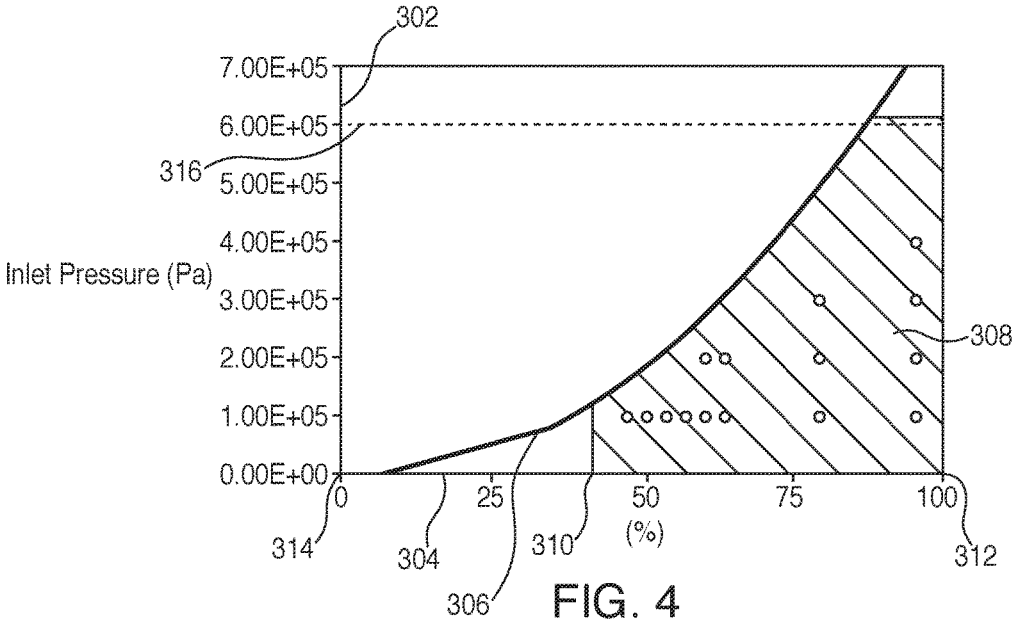
FIGS. 4 and 5 are representative cavitation maps in accordance with the disclosure.
Figure 5:
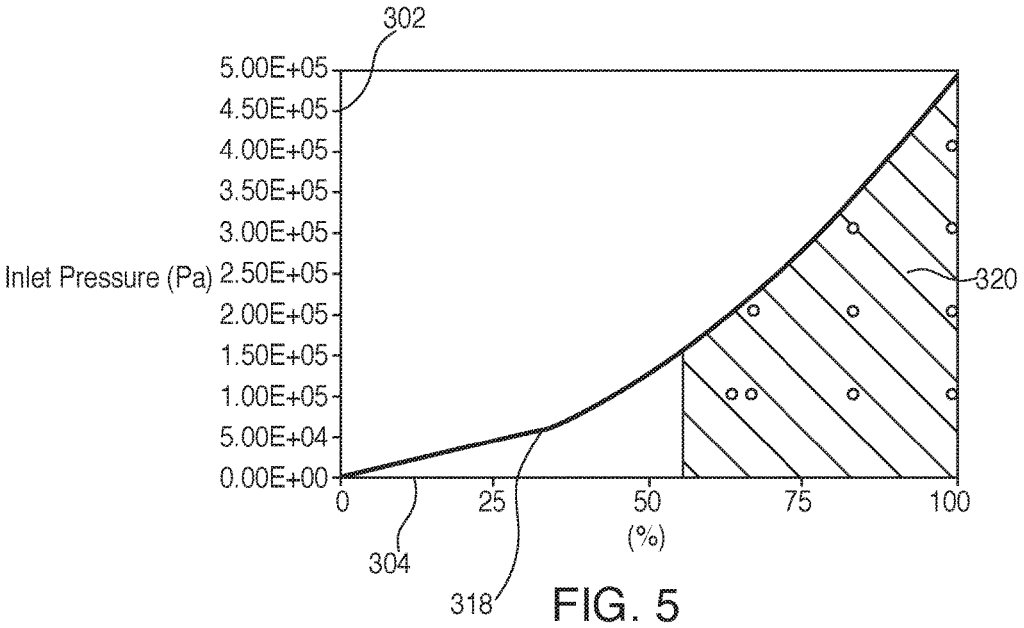

Two graphs showing qualitative effects of stimulation fluid cavitation at the inlet of the pump with respect to pump speed for two exemplary fluid compositions are shown in FIGS. 4 and 5. In FIG. 4, the properties of a water-sand mixture for use as a stimulation fluid is shown, and in FIG. 5 the properties of water are shown, for comparison. In the graph of FIG. 4, inlet pressure (in Pa) of stimulation fluid, in this case, a sand-water slurry, is plotted along the vertical axis 302, and the speed of a well stimulation pump, for example, the pump 116 (FIG. 1) in revolutions per minute (RPM) and as a percentage of a maximum pump speed is plotted along the horizontal axis 304. The graph illustrates a phase transition curve 306 for the slurry. The phase transition curve 306 represents a calculated collection of points on the graph at which conditions favorable for fluid cavitation may occur. It has been determined through analytical methods that a cavitation area 308 can be defined below the phase transition curve 306, which includes points at which at least some cavitation can be expected when the stimulation fluid enters into a pumping element of the pump.

As shown in the graph, the cavitation area is bound between low and high pump speeds, which are denoted respectively as 310 and 312 on the graph, and also between low and high pressures, which are denoted respectively as 314 and 316. The pump speed and inlet pressure ranges, as well as the curve 306, depend on the particular characteristics of the stimulation fluid such as sand or other aggregate content that makes up the slurry, the presence of gelling agents, and the like. For the water-sand mixture considered in creating the graph of FIG. 4, the pump speed range along the horizontal axis 304 over which the cavitation area 308 extends is between about 40% and 110% of the maximum pump speed, in terms of RPM, while the inlet pressure range along the vertical axis over which the cavitation area 308 extends is between about 0 and 600 kPa. For comparison, a stimulation fluid that includes mostly water and no sand, as shown in the graph of FIG. 5, defines a different cavitation area 320 that extends between pump speeds of 55% and 100% of the maximum pump speed, in terms of RPM, and inlet pressures of 0 to 450 kPa.

INDUSTRIAL APPLICABILITY

The present disclosure is applicable to pumps used for hydraulic fracturing or well stimulation applications. As discussed above, cavitation of the stimulation fluid within pumping elements is generally undesirable because it may cause wear or damage to pump components as well as it may decrease pumping efficiency. To reduce or eliminate pump and system operation under conditions at which cavitation may be present, the present disclosure describes a controller that monitors system operation and mitigates system operation under undesired operating conditions. This can be accomplished by lowering pump speed to avoid cavitation, raising the inlet pressure of the stimulation fluid provided to the pump, lowering the overall flow rate of stimulation fluid provided to the well through the system, activating backup or additional pumps, and others. These and other features can be automatically carried out by operating a control system within a controller, for example, the controller 130 (FIG. 1) or a similar controller that is configured to monitor and control operation of the system.

Figure 6:
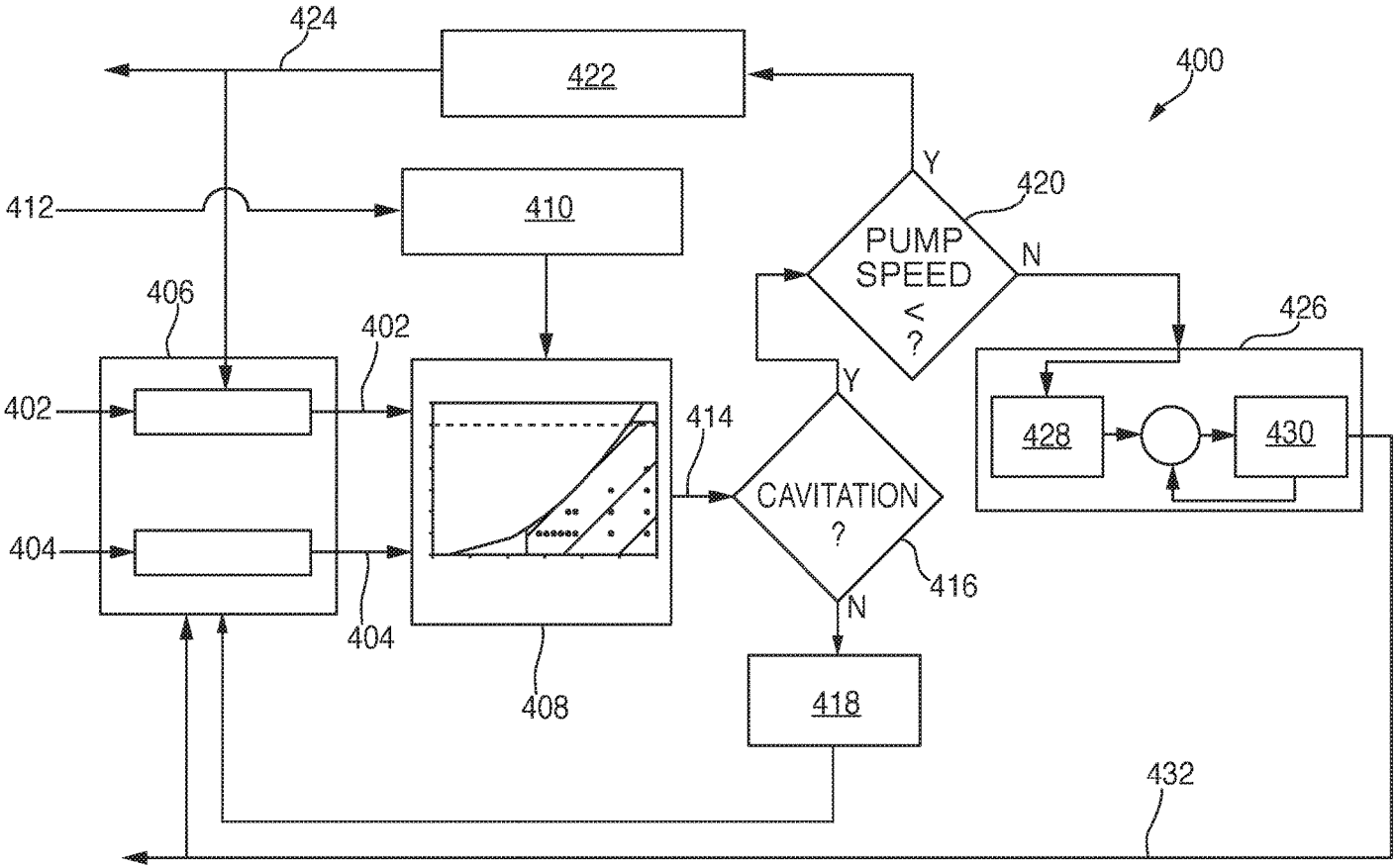
FIG. 6 is a schematic for a pump control in accordance with the disclosure.

A block diagram for a control system 400 in accordance with the disclosure is shown in FIG. 6. The control system 400 may be operating as a set of computer executable instructions within the electronic controller 130 (FIG. 1), or in another similarly disposed controller that is associated with a well stimulation system such as the system 100. The control system 400 receives information and signals indicative of the operating state of the system and automatically determines whether cavitation in the pump is likely to be present such that an automatic change, adjustment or mitigation can be undertaken to avoid the presence of the cavitation, by adjusting various operating parameters of the well stimulation system operation. In the illustrated embodiment, a signal indicative of pump inlet pressure 402, and also a signal indicative of pump speed 404, are provided to an inlet block 406, but it should be appreciated that additional or different parameters may be provided depending on the requirements of each system.

The control system 400 further includes a database 408 containing one or more predefined cavitation maps that include information on areas or ranges of operating parameters within which cavitation may occur, for example, as shown in FIGS. 4 and 5. Selection by the database 408 of the appropriate cavitation map that should be used is made based on predefined information about the type of fluid that is used. A variety of cavitation maps may be stored in the database. The active cavitation map for each operation of the control system 400 may be made based on fluid properties and inlet valve design, among others, which are provided as constants from a library 410 and/or from a selection 412 that is input to the system. The selection 412 may be a manual input from a user, or may be a sensor signal that is automatically provided, for example, as an informational signal from the mixer providing the stimulation fluid or by a sensor, for example, a viscosity sensor disposed to measure a viscosity of the stimulation fluid and provide an indication to the controller.

After the appropriate cavitation map has been selected based on the particular fluid and hardware configuration of a system, the database 408 compares or interpolates the then present pump speed 404 and inlet pressure 402 to determine an operating point of the system in terms of these parameters on the appropriate cavitation map, to determine whether the operating point is disposed within or at least approaches a cavitation area of the cavitation map. A determination 414 is provided to a determinator 416, which determines whether operation is within a cavitation area or, stated differently, a determination whether cavitation is presumed to be present in the pump. When no cavitation is present, the process returns at 418 to the inlet block 406 and operation at the then present inlet pressure and pump speed continues without changes due to cavitation. At times when cavitation is determined to be occurring, for example, if the inlet fluid composition or flow rate is changed, then the result of the determinator 416 is positive, and an interrogation of various system parameters to determine whether pump speed can be reduced is carried out at a pump speed change determinator 420.

The determination of whether the pump speed can be reduced can be carried out on various dimensions. For example, the application at the well stimulation process level may require the particular pump to maintain the same speed as other pumps in the system, in which case the speed of the particular pump cannot be easily reduced. When the speed of pump can be reduced, as decided at the determinator 420, pump speed reduction strategy 422 is implemented, and an internal and external indication of pump speed reduction 424 is provided to the inlet block 406 as well as to external systems. The indication, for example, may be provided to a transmission such as the transmission 126 (FIG. 1), to an engine or motor operating the pump, such as the power unit 122, and other systems that may operate to set a desired pump speed for the system.

At times when the pump speed cannot be reduced, a negative determination is provided from the determinator 420 to an inlet pressure control module 426. The inlet pressure control module 426 operates to control and adjust the inlet pressure of stimulation fluid provided to the pump such that the pressure can be increased when cavitation is present in the pump and the pump speed cannot be reduced. In the illustrated embodiment, the inlet pressure control module 426 adjusts a desired inlet pressure setpoint at a lookup function 428. A closed loop control system, for example, a PID control 430, then operates to increase the inlet pressure, for example, by increasing the flow or material to a mixer such as the mixer 106 (FIG. 1), or by increasing the opening or pressure setting of a valve controlling the stimulation fluid supply to the pump such as the valve 146 (FIG. 1). An indication 432 that an inlet pressure increase is being carried out may be provided internally to the inlet block 406 and also externally to other systems associated with the control system 400.

Figure 7:
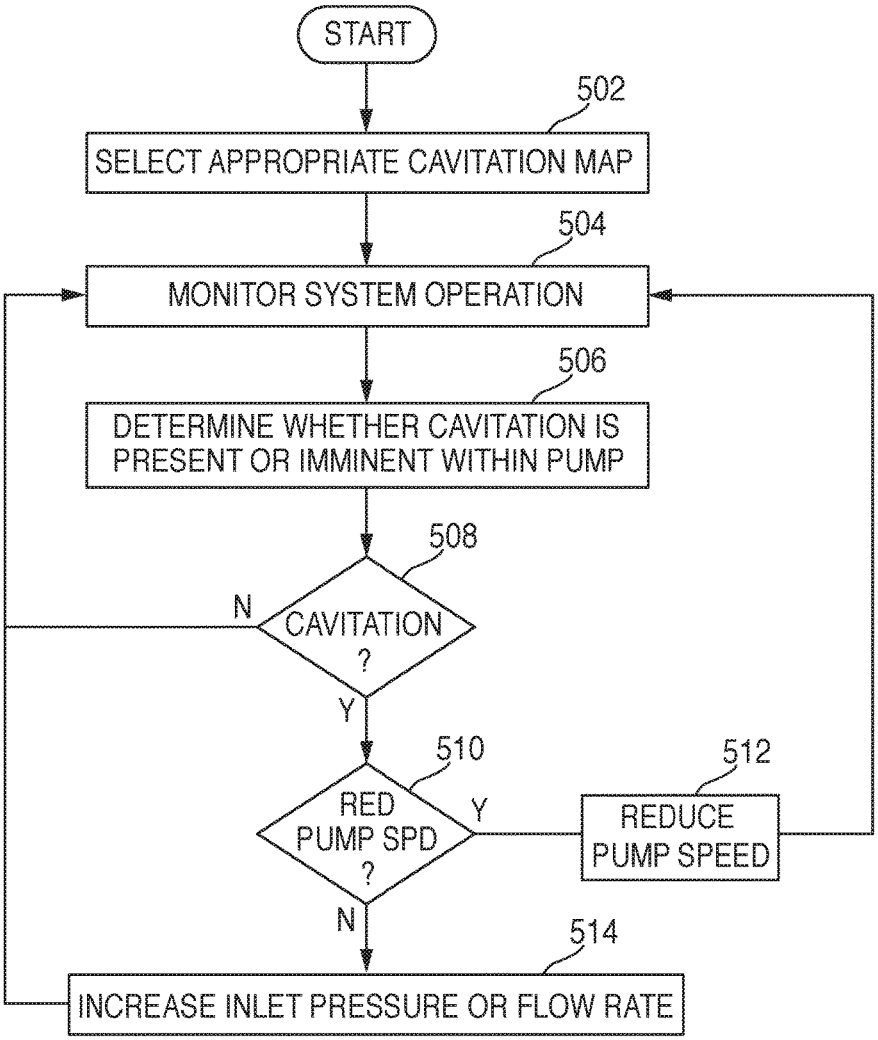
FIG. 7 is a flowchart for a method in accordance with the disclosure.

A flowchart for a method of operating a well stimulation pump is shown in FIG. 7. The process includes selecting an appropriate cavitation map at 502. The selection of the appropriate cavitation map may be carried out based on consideration of the particular fluid flow and material properties of the stimulation fluid provided to a pump. Once the appropriate cavitation map has been selected, operating parameters of the well stimulation system relative to the pump or pumps are monitored at 504. The parameters monitored may include various system parameters such as pump speed and fluid pressure at the inlet of the pump. Additional parameters may further speed and acceleration of the pump pistons and/or the inlet check valves of the pumping elements, and the like.

A determination is made at 506 of whether cavitation is present. The determination may be carried out by determining an operating point of the pump based on the monitored parameters, and a comparison of the operating point with a cavitation area on the appropriate cavitation map. When cavitation is not present at 508, the process repeats at 504 by monitoring the operating parameters of the system. In one embodiment, when cavitation is present at 508, the process continues at 510 where a determination is made whether the speed of the pump can be reduced. When the pump speed can be reduced, the process continues at 512 where the speed of the pump is reduced, and the process repeats at 504 with monitoring the parameters of the system. When the pump speed cannot be reduced, the process continues at 514 where actions are taken to increase the inlet pressure or flow rate capability of a fluid supply of fluid provided to the pump, and the process returns to 504 to monitor operating parameters.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A pumping system for use in a well stimulation application, comprising:

a pump having an inlet and at least one pumping element, each pumping element including a piston reciprocally disposed in a bore, an inlet check valve in fluid communication with the inlet and an outlet check valve associated with a variable volume defined in a bore;

a pressure sensor disposed to measure a fluid pressure at a location between the inlet check valve and the inlet of the pump;

a drive mechanism for driving a reciprocal motion of the piston;

a speed sensor disposed to measure a speed of the pump at the drive mechanism; and a controller associated with the pump and disposed to receive signals indicative of the fluid pressure and the speed of the pump;

wherein the controller is programmed to:

determine an operating point of the pump based on the fluid pressure and the speed of the pump;

compare the operating point of the pump with a cavitation map that is predefined;

determine whether cavitation is present in the at least one pumping element based on a result of the comparison between the operating point and the cavitation map; and when cavitation is present, at times, adjust an operation of the drive mechanism to reduce a speed of the pump, and provide an indication of a desired slurry composition.

2. The pumping system of claim 1, wherein the cavitation map includes a two dimensional array of operating points with respect to the fluid pressure and the speed of the pump, and wherein a cavitation area is defined by a collection of operating points in the cavitation map at which cavitation occurs or is imminent.

3. The pumping system of claim 2, wherein the controller is further programmed to interpolate the operating point of the pump onto the cavitation map, and to determine whether the operating point of the pump falls within the cavitation area.

4. The pumping system of claim 1, wherein the drive mechanism includes a driver connected to an input drive shaft of the pump via a transmission device.

5. The pumping system of claim 4, wherein the controller adjusts the operation of the drive mechanism by commanding a change in a gear ratio of the transmission.

6. The pumping system of claim 4, wherein the driver includes an internal combustion engine connected to an electrical power generator, and an electric motor that is connected to the input drive shaft of the pump and wherein, during operation, the internal combustion engine operates the electrical power generator to produce electrical power, which electrical power is provided to operate the electric motor.

7. The pumping system of claim 6, wherein the controller adjusts the operation of the drive mechanism by commanding a change in a rotational speed of the electric motor.

8. The pumping system of claim 1, wherein the inlet of the pump is adapted to be connected to a source of stimulation fluid via a valve, the valve being responsive to commands from the controller for adjusting at least one of a flow rate and a pressure of stimulation fluid provided to the inlet of the pump.

9. The pumping system of claim 8, wherein the controller is further programmed to, at times when cavitation is present, adjust a position of the valve to increase the pressure of stimulation fluid provided to the inlet of the pump.

10. The pumping system of claim 8, wherein the source of stimulation fluid is a mixer device that is configured to provide a fluid in mixture with an aggregate as the slurry to the inlet of the pump, and wherein the mixer device is responsive to commands to adjust the composition of the slurry.

11. The pumping system of claim 1, wherein the controller is programmed to store in a database a plurality of predefined cavitation maps, and to select an appropriate cavitation map based on system operating parameters, the system operating parameters including physical characteristics of the stimulation fluid provided to the inlet of the pump and flow characteristics of piping associated with the pump.

12. The pumping system of claim 1, further including a second pump connected in parallel flow arrangement with the pump, wherein the controller is further programmed to adjust operation of the second pump when cavitation is present in the pump.

13. A method for operating a pump for use in a hydraulic fracturing system, comprising:

in a controller, selecting one appropriate cavitation map from a plurality of cavitation maps stored in the controller, the selecting being based on operating parameters of the hydraulic fracturing system;

using the controller, monitoring operation of the hydraulic fracturing system with regard to at least a pressure of stimulation fluid at an inlet of a pump, and a speed of the pump, to determine an operating condition of the pump;

in the controller, comparing the operating condition of the pump with the selected one appropriate cavitation map;

by use of the controller, determining whether cavitation is present or imminent in the pump based on a result of the comparison; and when cavitation is present, using the controller to adjust the operating condition of the pump, in real time, and using the controller to provide an indication of a desired slurry composition.

14. The method of claim 13, wherein adjusting the operating condition of the pump includes increasing a pressure of the stimulation fluid at the inlet of the pump.

15. The method of claim 13, wherein adjusting the operating condition of the pump includes reducing the speed of the pump.

16. The method of claim 13, wherein reducing the speed of the pump includes at least one of changing a gear ratio in a transmission device disposed between a power unit used to operate the pump and an input shaft of the pump, reducing a speed of an internal combustion engine used to operate the pump, and reducing an amount of electrical power provided to a motor operating the pump.

17. The method of claim 13, further comprising connecting the inlet of the pump to a source of stimulation fluid via a valve, the valve being responsive to commands from the controller for adjusting at least one of a flow rate and a pressure of stimulation fluid provided to the inlet of the pump, and adjusting a position of the valve to increase the pressure of stimulation fluid provided to the inlet of the pump.

18. The method of claim 17, wherein the source of stimulation fluid is a mixer device that is configured to provide a fluid in mixture with an aggregate as the slurry to the inlet of the pump, wherein the mixer device is responsive to commands to adjust the composition of the slurry.

19. The method of claim 13, wherein the system further includes a second pump connected in parallel flow arrangement with the pump, and wherein adjusting the operating condition of the pump is accomplished at least in part by adjust a corresponding operating condition of the second pump.

* * * * *